United States Patent [19]

Herrington

[11] 4,195,590

[45] Apr. 1, 1980

[54] DOOR CASING HARDWARE PAINT SHIELD

[76] Inventor: Billie M. Herrington, 4636 Valley Garden SW., Albuquerque, N. Mex. 87105

[21] Appl. No.: 905,512

[22] Filed: May 12, 1978

[51] Int. Cl.[2] ..... B05C 11/16; B05B 15/04; B05C 5/00

[52] U.S. Cl. ..... 118/505; 118/301; 427/282

[58] Field of Search ..... 118/505, 301, 504, 406; 427/272, 282; 51/310

[56] References Cited

U.S. PATENT DOCUMENTS

| | | | |
|---|---|---|---|
| 2,227,453 | 1/1941 | Koch | 118/505 |
| 2,332,579 | 10/1943 | Kirby | 118/505 |
| 3,722,470 | 3/1973 | Farrell | 118/505 |
| 3,961,602 | 6/1976 | Dresser | 118/505 |

*Primary Examiner*—Richard L. Schilling
*Attorney, Agent, or Firm*—Walter R. Keller

[57] ABSTRACT

Reusable clip-on paint shields for hinges and striker plates in door casings, intended to be applied over butt plates of door hinges and door striker plates to protect them from paint spray and the like while the door, door casing, or room are being painted.

4 Claims, 3 Drawing Figures

DOOR CASING HARDWARE PAINT SHIELD

SUMMARY

The present invention recognizes the time consuming task of masking door hinges butt plates and door striker plates prior to spray painting the interior of a house. Normally, the doors are removed and stored elsewhere, as in the garage and painted separately. A new house, especially, it takes a painter considerable time to mask with adhesive masking tape the butt plate and the striker plates on the door casing prior to spray painting. It is an objective of the invention, to provide a butt cover and a striker plate cover which can be easily attached and removed, and is reuseable. Another feature of the invention provides paint covers which are relatively simple in construction and which therefore may be readily manufactured at a low cost.

BACKGROUND OF THE INVENTION

1. Field of the Invention.

This invention relates generally to painting accessories and move particularly to paint masks for hardware from being painted, splattered, and smudged during the painting of the door casing, or room especially by spray painting.

2. Description of Prior Art.

In painting a house, apartment building or other structures having striker plates, the problem of protecting the hardware on the casing from being painted, splattered, or smudged has in the past, been solved primarily by applying adhesive masking tape to the hardward for protection. DRESSER, U.S. Pat. No. 3,961,602 discloses shaped, pre-cut masking tape butt covers; which work suitably, but are not reusable, and take time to apply accurately.

It would thus be desireable to provide a means for protecting the hardware on the door casing against paint smears and paint spray while painting.

DESCRIPTION OF THE PREFERRED EMBODIMENT

Figure 1:
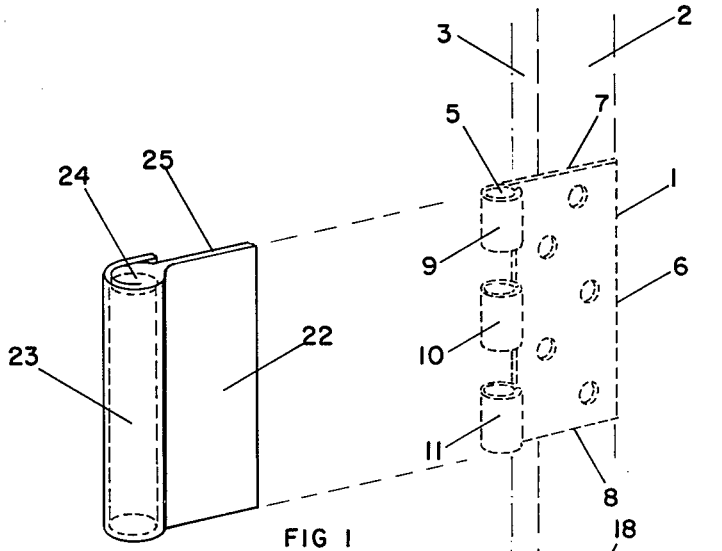
FIGS. 1 and 3 are perspective views of a hinge butt cover being applied to a butt plate of a hinge member affixed to a door jamb.
Figure 3:
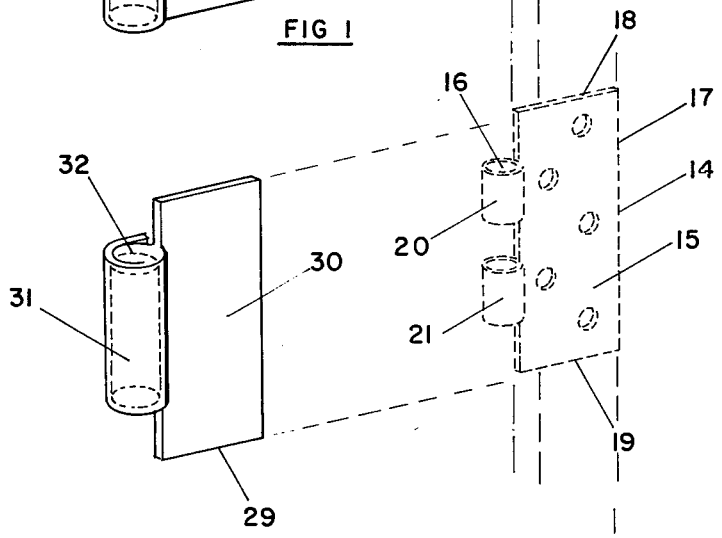

The invention comprises a set of paint covers to be applied to hardware affixed to door casings. The butt plate of a hinge member 1 as shown in FIG. 1 mounted in a face surface 2 of door jamb 3 in a conventional manner, has an exposed surface 4, a back surface 5, an inner edge 6, top and bottom edges 7 and 8 respectively, and three vertically aligned cylindrical open ended members 9, 10, 11 which are virtically spaced apart from each other. Normally there are not more than three butt plates of hinge members 1 on each door jamb 3. On the opposite side of the door jamb is mounted a striker plate 12 having a latch access hole 13, as shown on FIG. 2. A hinge comprises a butt plate member 1 a hinge pin and a door member 14. Occasionally, the hinge members 2 and 4 are mounted on doors and door casing in a reverse manner so that the door member 14, usually mounted on the door, is erroneously affixed to the door jamb 3 as shown in FIG. 3. Functionally, the door member 14 then becomes a butt plate. Door member 14 has an exposed surface 15, a back surface 16, an inner edge 17, a top edge 18, a bottom edge 19, and two vertically alligned cylindrical open ended members 20 and 21 which are spaced vertically apart from each other.

The invention comprises paint covers shaped to cover the butt plate 1, the door member 14 and striker plate 12. The paint cover 25 for the butt plate is made of a sheet of rigid yet slightly flexible material to clip with a spring action onto the three cylindrical open ended members 9, 10, 11. The paint cover 25 is formed to have a flat plate portion 22, a cylindrical portion 23, and a cap 24 as shown in FIG. 1. The flat plate portion 22 is shaped and sized to cover the exposed surface 4 of the butt plate 1 to the top edge 7, bottom edge 8, and the inner edge 6 when in place. The cylindrical portion 23 is shaped to complimentarily receive, engage and cover all three cylindrical open ended members 9, 10, and 11 of the butt plate 1, and the back surface 5. The cylindrical portion 23 is shaped to snuggly and frictionally clip on the cylindrically open ended members 9, 10, and 11 of the butt plate 1. The cap 24 is a flat section whose plane is perpendicular to the plane of the flat plate portion 22 and performs two functions. The cap 24 covers the interior of the three cylindrical open ended members 9, 10, and 11 of the butt plate 1 and prevents paint from getting inside or on the edge of the top cylindrical member 9. In addition, cap 24 prevents the butt plate paint cover 25 from sliding down and becoming misaligned.

Figure 2:
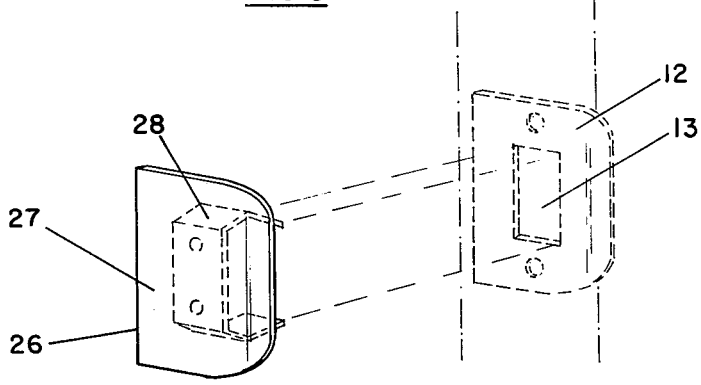
FIG. 2 is a perspective view of a striker plate cover being applied to a striker plate affixed to a door jamb.

As shown in FIG. 2, a paint cover 26 for the striker plate 12 consists of a cover portion 27 shaped to cover to the edges of the striker plate 12, and two prongs 28 which insert into the latch access hole 13, and frictionally hold the paint cover 26 in place.

A paint cover 28 for the door member 14 consists of a flat portion 30, a cylindrical portion 31, and a cap 32. The difference between the paint cover 29 for a door member 14 and the paint cover 25 for a butt plate 1 is that cylindrical portion 31 is not exposed surface 15 but is instead only high enough to cover the two cylindrical open ended members 20, and 21. The caps 32 being located on top of cylindrical portion 31 then still prevents the paint cover 29 for a door member 14 from sliding or becoming misalligned.

The invention then comprises a paint covers 25 for butt plates 1, paint cover 26 for a striker plate 2; paint covers 29 for door member 14. In use a painter preparing a house for painting would have sufficient sets with paint covers 25 for butt plates 1 mounted in the door jamb 3 to accommodate the house, but would have one or two sets with paint covers 29 for door members 14 mounted in the door jamb 3. The painter then, after the doors have been removed, in only a few minutes apply the apint covers 25, 26, or 29 as appropriate and all of the door jambs 3 in the entire house is ready for painting. After painting, the paint covers 25, 26, and 29 are merely removed, doors, hinges and the task completed. The paint covers 25, 26 and 29 are easily cleaned and ready for use in the next house.

I claim:

1. A set of reuseable paint covers for all the installed hardware in door jambs to permit complete painting of the door jamb and nearly walls, in one operation, said set of pain covers protecting the installed hardware from paint and paint splatters; said set of paint covers comprising a paint cover for a hinge butt plate member, a paint cover for a striker plate, a paint cover for the door members of a hinge; said set of paint covers being made of rigid yet slightly flexible material.

2. The paint covers of claim 1 wherein the paint cover for a hinge butt plate member is made of rigid, yet slightly flexible material, having a flat surface, a cylindrical portion and a cap, so shaped so that the paint cover complimentarily receives and engages three cylindrical open ended members of the hinge butt plate.

3. The paint covers of claim 1 wherein the paint cover for a striker plate comprises a shaped cover portion and two prongs which insert into access hole in the striker plate and frictionally hold the paint cover for a striker plate in position.

4. The paint covers of claim 1 wherein the paint cover for a door member of a hinge is made of rigid yet slightly flexible material, having a flat surface, a cylindrical portion and a cap, so shaped that the paint cover complimentarily receives, engages, and covers two cylindrical open ended members of the door member of the hinge.

* * * * *